US008444406B2

(12) United States Patent
Fuchs

(10) Patent No.: US 8,444,406 B2
(45) Date of Patent: May 21, 2013

(54) GEAR PUMP WITH REDUCED PRESSURE PULSATIONS ON THE PUMPING SIDE

(75) Inventor: Alexander Fuchs, Adnet (AT)

(73) Assignee: Robert Bosch GmbH, Stuttgart (DE)

( * ) Notice: Subject to any disclaimer, the term of this patent is extended or adjusted under 35 U.S.C. 154(b) by 863 days.

(21) Appl. No.: 12/443,328

(22) PCT Filed: Jul. 30, 2007

(86) PCT No.: PCT/EP2007/057821

§ 371 (c)(1),
(2), (4) Date: Oct. 9, 2009

(87) PCT Pub. No.: WO2008/037525

PCT Pub. Date: Apr. 3, 2008

(65) Prior Publication Data

US 2010/0047102 A1 Feb. 25, 2010

(30) Foreign Application Priority Data

Sep. 28, 2006 (DE) ..... 10 2006 045 932

(51) Int. Cl.

| | |
|---|---|
| ***F01C 1/18*** | (2006.01) |
| ***F03C 2/00*** | (2006.01) |
| ***F03C 4/00*** | (2006.01) |
| ***F04C 2/00*** | (2006.01) |

(52) U.S. Cl.
USPC ..... 418/206.1; 418/80; 418/180; 418/206.6

(58) Field of Classification Search
USPC ..... 418/15, 150, 180, 206.1–206.8, 80
See application file for complete search history.

(56) References Cited

U.S. PATENT DOCUMENTS

| | | | | |
|---|---|---|---|---|
| 6,527,530 | B2 * | 3/2003 | Boehland et al. | 418/180 |
| 6,935,851 | B2 * | 8/2005 | Peters et al. | 418/180 |
| 2004/0228752 | A1 | 11/2004 | Peters et al. | |

FOREIGN PATENT DOCUMENTS

| | | | |
|---|---|---|---|
| DE | 10134622 | A1 | 2/2003 |
| JP | 2000205146 | A | 7/2000 |
| JP | 2002242854 | A | 8/2002 |
| JP | 2003531339 | A | 10/2003 |

* cited by examiner

*Primary Examiner* — Theresa Trieu
(74) *Attorney, Agent, or Firm* — Michael Best & Friedrich LLP

(57) ABSTRACT

The invention relates to a gear pump in which the amplitudes of the pressure impulses in a pressure chamber can be significantly reduced by a suitable embodiment of a first groove and/or a second groove. The circumferential walls of a pump chamber containing the pressure chamber, in an angular range extending toward the pressure chamber, each have a respective groove communicating with the pressure chamber, by which grooves a radial spacing between the outer circumference of two gear wheels disposed in the pump chamber and the circumferential walls is increased.

20 Claims, 2 Drawing Sheets

GEAR PUMP WITH REDUCED PRESSURE PULSATIONS ON THE PUMPING SIDE

CROSS-REFERENCE TO RELATED APPLICATION

This application is a 35 USC 371 application of PCT/EP 2007/057821 filed on Jul. 30, 2007.

BACKGROUND OF THE INVENTION

1. Field of the Invention

The invention is based on a gear pump, in particular for pumping fuel from a fuel tank to a high-pressure fuel pump.

2. Description of the Prior Art

One such gear pump is known from German Patent Disclosure DE 101 34 622 A1. This gear pump has a housing, in which a pump chamber is formed in which a pair of gear wheels meshing with each other on their outer circumference is disposed. The gear wheels pump the medium to be pumped along pumping conduits, formed between their outer circumference and adjacent circumferential walls of the pump chamber, from a suction chamber into a pressure chamber. In operation of the gear pump, a tooth gap of one gear wheel reaches the pressure chamber, and a tooth gap of the other gear wheel reaches the pressure chamber after it, in chronological succession. The angle of rotation of the gear wheels corresponding to this spacing amounts here to 360°/2z in each case, where z is the number of teeth of the gear wheels.

Upon the entry of a tooth gap into the pressure chamber, the volume of the pressure chamber is increased, causing the pressure in the pressure chamber to drop. In operation of the gear pump, pressure pulsations thus occur in the pressure chamber, which have a period corresponding to half the tooth pitch angle of the gear wheels. For a number of teeth z=10, the period is thus 18°, relative to the respective axes of rotation of the gear wheels. In other words, after 18° of an angle of rotation of each of the gear wheels, one tooth gap enters the pressure chamber, and the pressure chamber volume is increased. The pressure pulsations lead to high mechanical stress on the gear pump, which must be taken into account by means of an expensive construction of the gear pump that has the requisite strength. Moreover, the pressure pulsations reduce the pumping capacity of the gear pump. To reduce these pulsations, it has been proposed in DE 101 34 622 A1 that grooves be provided, by which the radial spacing between the outer circumference of the gear wheels and the circumferential walls is increased. By means of this provision, it has already been possible to achieve a significant reduction in the amplitudes of the pressure pulsations.

OBJECT AND SUMMARY OF THE INVENTION

The invention has the object of furnishing a gear pump in which further reduced amplitudes of the pressure pulsations are achieved.

The gear pump according to the invention has the advantage that as a result of the different radial spacings of the grooves in the circumferential walls of the pump chamber, a further reduction of the pressure pulsations is attained. As a result, the mechanical stress on the gear pump is reduced, so that the pump can be manufactured more economically. Moreover, the pumping capacity of the gear pump is improved as a result.

BRIEF DESCRIPTION OF THE DRAWINGS

One exemplary embodiment of the invention is shown in the drawings and described in further detail in the ensuing description, in which.

DESCRIPTION OF THE PREFERRED EMBODIMENT

Figure 1:
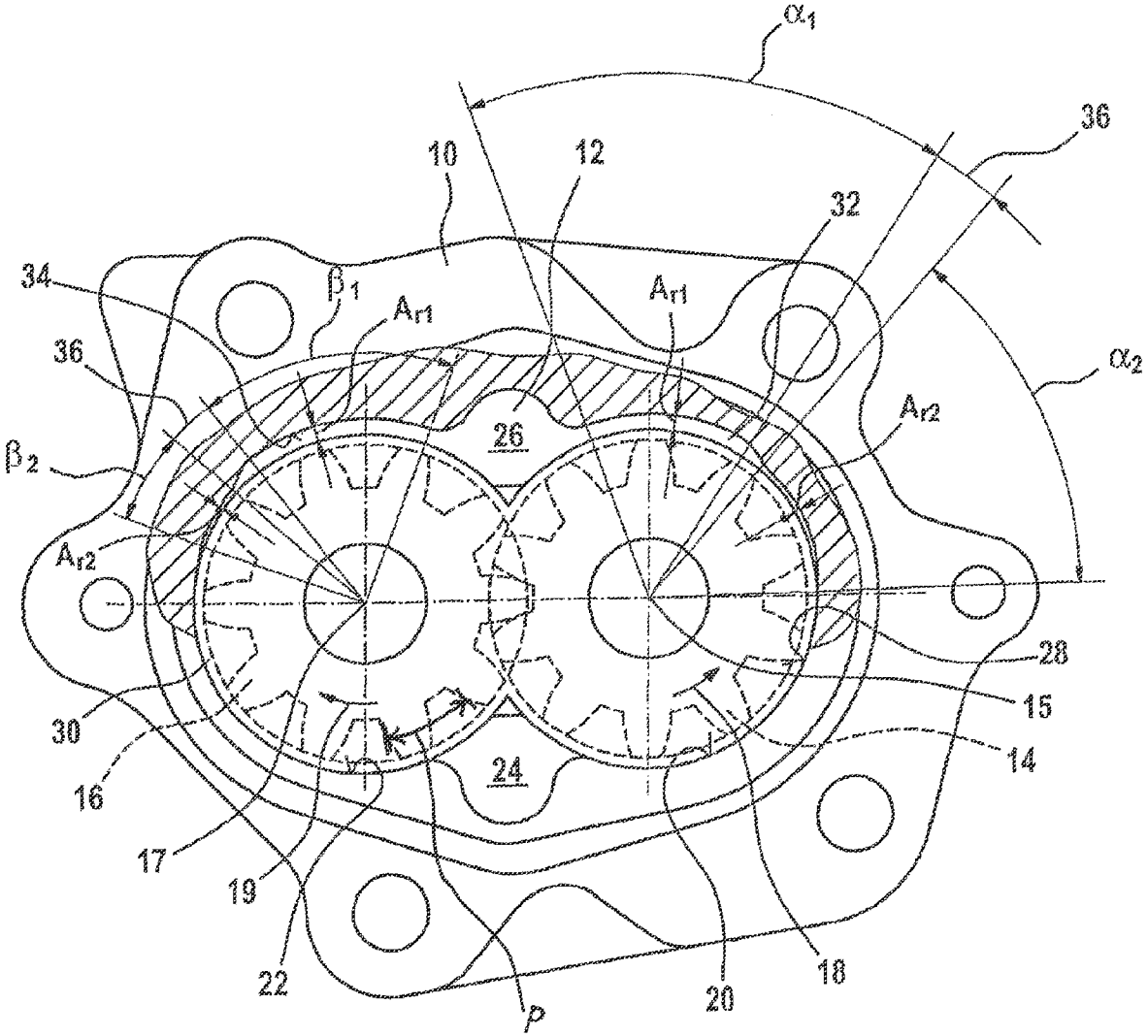
FIG. 1 shows a gear pump in a cross section.

In FIG. 1, a gear pump is shown that serves in particular for pumping fuel from a fuel tank to a high-pressure pump of a fuel injection system of an internal combustion engine of a motor vehicle. The gear pump has a multi-part housing, with one housing part 10 in which a pump chamber 12 is formed. A pair of gear wheels 14, 16, meshing with one another on their outer circumference and each having a face-end serration, is disposed in the pump chamber 12. The gear wheel 14 is supported rotatably about an axis 15, and the gear wheel 16 is supported rotatably about an axis 17. One of the gear wheels 14, 16, for instance the gear wheel 14, is driven in a manner not shown in further detail to revolve about its axis of rotation 15 in a direction of rotation 18, and via a tooth engagement it drives the other gear wheel 16 to rotate about its axis of rotation 17 in a direction of rotation 19. The teeth of the gear wheels 14, 16 define a circular pitch p.

The pump chamber 12 has circumferential walls 20, 22, which are oriented toward the outer circumferences of the gear wheels 14, 16 and are suitably curved in concave fashion. The gear wheels 14, 16 mesh approximately in the middle of the pump chamber 12; originating with the tooth engagement of a gear wheel 14, 16 on the side pointing in the directions of rotation 18, 19, a suction chamber 24 is formed in the pump chamber 12, and on the side pointing counter to the directions of rotation 18, 19, a pressure chamber 26 is formed in the pump chamber 12. Beginning at the suction chamber 24, one pumping conduit 28, 30 each is formed between the outer circumference of the respective gear wheel 14, 16 and the adjoining circumferential wall 20, 22 of the pump chambers 12 In operation of the gear pump, fuel is pumped out of the suction chamber 24 along the pumping conduits 28, 30 into the pressure chamber 26 by the gear wheels 14, 16 in their tooth gaps. An inlet from the fuel tank discharges into the suction chamber 24, and a communication with the high-pressure fuel pump leads away from the pressure chamber 26.

In the circumferential wall 20 of the pump chamber 12 oriented toward the gear wheel 14, a groove 32 is embodied, by which the radial spacing between the outer circumference of the gear wheel 14 and the circumferential wall 20 is increased. The first groove 32 extends in the direction of rotation 18 of the gear wheel 14 as far as the beginning of the pressure chamber 26. In a first angular range $\alpha_1$ of the first groove 32, there is a radial spacing $A_{r1}$ between the circumferential wall 20 and the first gear wheel 14. In a second angular range $\alpha_2$ of the first groove 32, there is a radial spacing $A_{r2}$ between the circumferential wall 20 and the first gear wheel 14, and $A_{r1}$ is not equal to $A_{r2}$. In the exemplary embodiment shown in FIG. 1, $A_{r1}$ is greater than $A_{r2}$. At least one of the first angular range $\alpha_1$ and the second angular range $\alpha_2$ is greater than the circular pitch p. In the illustrated embodiment, both the first angular range $\alpha_1$ and the second angular range $\alpha_2$ are greater than the circular pitch p.

In the circumferential wall 22 of the pump chamber 12 oriented toward the gear wheel 16, a second groove 34 is embodied, by which the radial spacing between the outer circumference of the gear wheel 16 and the circumferential wall 22 is increased. The second groove 34 extends in the direction of rotation 19 of the gear wheel 16 as far as the beginning of the pressure chamber 26. In a first angular range $\beta_1$ of the second groove 34, there is a radial spacing $A_{r1}$ between the circumferential wall 22 and the second gear wheel 16. In a second angular range $\beta_2$ of the second groove 34, there is a radial spacing $A_{r2}$ between the circumferential wall 22 and the first gear wheel 14, and $A_{r1}$ is not equal to $A_{r2}$. In the exemplar embodiment shown in FIG. 1, $A_{r1}$ is greater than $A_{r2}$. At least one of the first angular range $\beta_1$ and the second angular range $\beta_2$ is greater than the circular pitch p. In the illustrated embodiment, the first angular range $\beta_1$ is greater than the circular pitch p and the second angular range $\beta_2$ is less than the circular pitch p.

As a result of this embodiment of the grooves 32, 34 a further reduction in the pressure pulsations is attained. Alternatively, the same effect can also be attained by means of a purposeful arrangement of a plurality of grooves, each of constant cross section. However, that variant is more expensive to produce and has a greater tendency to cavitation.

To prevent cavitation phenomena: the transition regions 36 between the first angular ranges $\alpha_1$, $\beta_1$ on the one hand and the second angular ranges $\alpha_2$, $\beta_2$ on the other are rounded. In a simplified embodiment, the transition regions 36 may also be shortened or even be omitted entirely.

Figure 2:
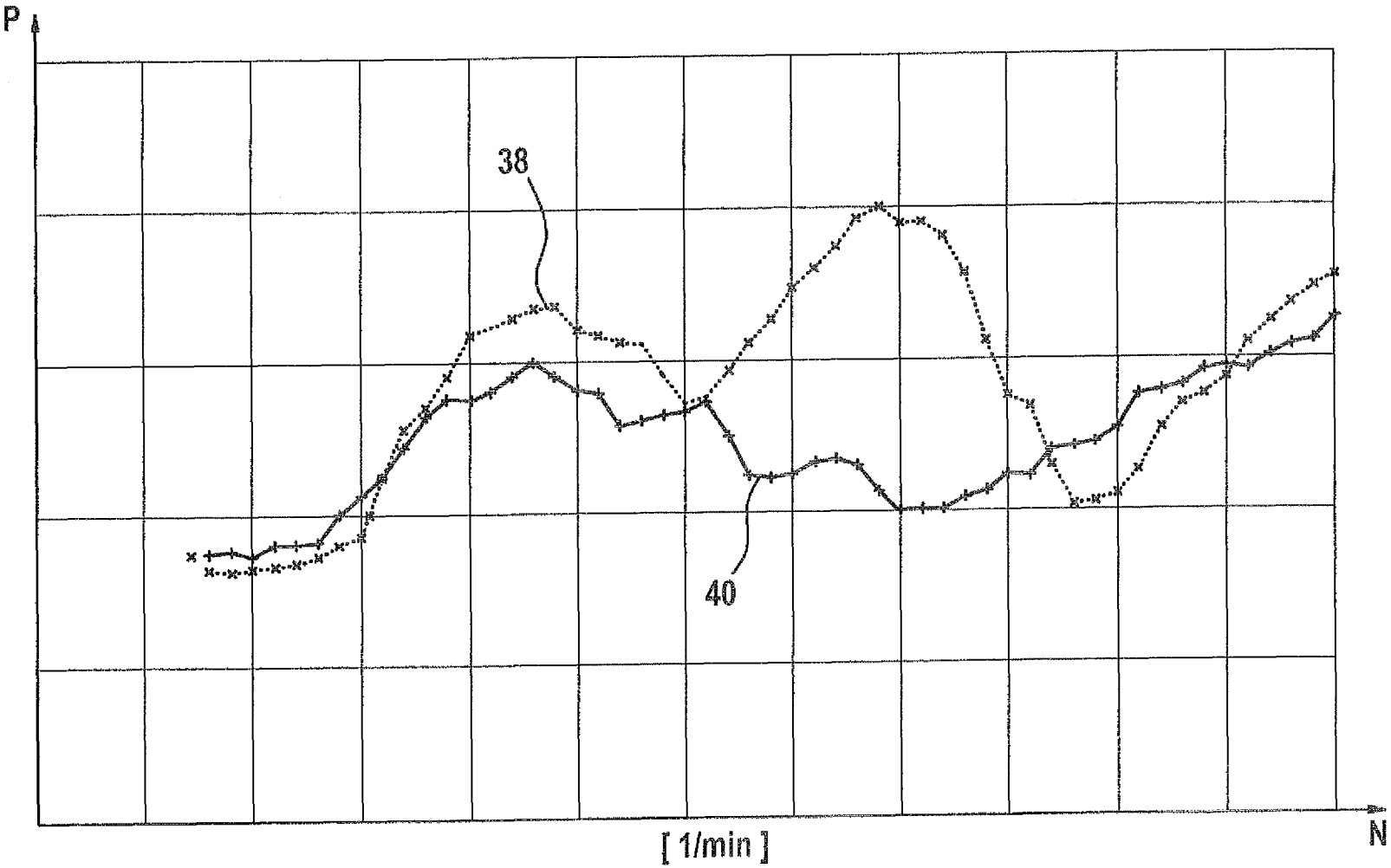
FIG. 2 shows the course of pressure pulsations in the pressure chamber of the gear pump.

In FIG. 2, the amplitude of the pressure pulsations in the pressure chamber 26 is plotted over the rpm n of the gear pump. A first line 38 indicates the amplitude of the pressure pulsations of a gear pump according to the prior art. A second line 40 represents the amplitude of the pressure pulsations in a gear pump according to the invention.

A comparison of the first line 38 and the second line 40 makes it immediately clear that the amplitudes of the pressure pulsations in the gear pump of the invention can be reduced even more markedly, compared to the gear pump known from DE 101 34 622 A1. As a result, the gear pump of the invention can not only be made lighter in weight and produced more economically, but the pressure regulation in the low-pressure region of the fuel injection system is also improved on the intake side of a downstream high-pressure fuel pump.

The foregoing relates to the preferred exemplary embodiment of the invention, it being understood that other variants and embodiments thereof are possible within the spirit and scope of the invention, the latter being defined by the appended claims.

The invention claimed is:

1. A gear pump for pumping fuel from a fuel tank to a high-pressure fuel pump, comprising:

a housing;

a pump chamber formed in the housing and having circumferential walls;

a pair of gear wheels meshing with one another disposed in the pump chamber;

pumping conduits formed between outer circumferences of the gear wheels and the circumferential walls of the pump chamber that border on these outer circumferences, in which the fuel is pumped along; and a respective groove formed in each of the circumferential walls of the pump chamber, within angular ranges of the circumferential walls extending toward a pressure chamber, each of the respective grooves communicating with the pressure chamber, whereby a radial spacing between an outer circumference of the gear wheels and the circumferential walls is increased, and wherein the radial spacing between the outer circumference of the gear wheels and the circumferential walls assumes different values within the grooves, wherein relative to a respective axis of rotation of the gear wheels, ends of the grooves are disposed identically in the pressure chamber, and beginnings of the grooves are disposed away from the ends at different angular spacings.

2. The gear pump as defined by claim 1, wherein inside a first angular range of a first groove, the radial spacing between the outer circumference of a first gear wheel and the circumferential wall is greater in a region of the first groove than the radial spacing between an outer circumference of a first gear wheel and the circumferential wall inside a second angular range of the first groove.

3. The gear pump as defined by claim 2, wherein the first angular range of the first groove is disposed closer to the pressure chamber than the second angular range of the first groove is.

4. The gear pump as defined by claim 3, wherein inside a first angular range of a second groove, the radial spacing between the outer circumference of a second gear wheel and the circumferential wall is greater in a region of the second groove than the radial spacing between an outer circumference of the second gear wheel and the circumferential wall inside a second angular range of the second groove.

5. The gear pump as defined by claim 4, wherein the first angular range of the second groove is disposed closer to the pressure chamber than the second angular range of the second groove is.

6. The gear pump as defined by claim 2, wherein inside a first angular range of a second groove, the radial spacing between the outer circumference of a second gear wheel and the circumferential wall is greater in a region of the second groove than the radial spacing between an outer circumference of the second gear wheel and the circumferential wall inside a second angular range of the second groove.

7. The gear pump as defined by claim 6, wherein the first angular range of the second groove is disposed closer to the pressure chamber than the second angular range of the second groove is.

8. The gear pump as defined by claim 6, wherein at least one of the first angular range and the second angular range is greater than or approximately equal to a circular pitch of a tooth of the gear wheels.

9. The gear pump as defined by claim 6, wherein the first angular range of the first groove is the same size as the first angular range of the second groove.

10. The gear pump as defined by claim 6, wherein the second angular range of the first groove is the same size as the second angular range of the second groove.

11. The gear pump as defined by claim 2, wherein at least one of the first angular range and the second angular range is greater than or approximately equal to a circular pitch of a tooth of the gear wheels.

12. The gear pump as defined by claim 11, wherein the first angular range of the first groove is the same size as the first angular range of the second groove.

13. The gear pump as defined by claim 11, wherein the second angular range of the first groove is the same size as the second angular range of the second groove.

14. The gear pump as defined by claim 1, wherein inside a first angular range of a second groove, the radial spacing between the outer circumference of a second gear wheel and the circumferential wall is greater in a region of the second groove than the radial spacing between the an outer circumference of the second gear wheel and the circumferential wall inside a second angular range of the second groove.

15. The gear pump as defined by claim 14, wherein the first angular range of the second groove is disposed closer to the pressure chamber than the second angular range of the second groove is.

16. The gear pump as defined by claim 14, wherein at least one of the first angular range and the second angular range is greater than or approximately equal to a circular pitch of a tooth of the gear wheels.

17. The gear pump as defined by claim 1, wherein the circumferential walls have transitions from the first angular ranges to the second angular ranges which are rounded.

18. The gear pump as defined by claim 1, wherein the angular ranges over which the grooves extend are determined such that at least approximately simultaneously for both gear wheels, a respective tooth gap or a tooth comes into coincidence with a respective groove.

19. A gear pump for pumping fuel from a fuel tank to a high-pressure fuel pump, comprising:

a housing;

a pump chamber formed in the housing and having circumferential walls;

a pair of gear wheels meshing with one another disposed in the pump chamber;

pumping conduits formed between outer circumferences of the gear wheels and the circumferential walls of the pump chamber that border on these outer circumferences, in which the fuel is pumped along; and a respective groove formed in each of the circumferential walls of the pump chamber, within angular ranges of the circumferential walls extending toward a pressure chamber, each of the respective grooves communicating with the pressure chamber, whereby a radial spacing between an outer circumference of the gear wheels and the circumferential walls is increased, and wherein the radial spacing between the outer circumference of the gear wheels and the circumferential walls assumes different values within the grooves, a first one of the respective grooves defining a first angular range ($\alpha$1) in which a radial spacing between the outer circumference of a respective gear wheel and the circumferential wall is a first radial spacing, and a second angular range ($\beta$2) in which a radial spacing between the outer circumference of the respective gear wheel and the circumferential wall is a second radial spacing, wherein the first radial spacing is greater than the second radial spacing, and wherein the first radial spacing is constant.

20. A gear pump for pumping fuel from a fuel tank to a high-pressure fuel pump, comprising:

a housing;

a pump chamber formed in the housing and having circumferential walls;

first and second gear wheels meshing with one another disposed in the pump chamber;

pumping conduits formed between outer circumferences of the gear wheels and the circumferential walls of the pump chamber that border on these outer circumferences, in which the fuel is pumped along; and a respective groove formed in each of the circumferential walls of the pump chamber, within angular ranges of the circumferential walls extending toward a pressure chamber, each of the respective grooves communicating with the pressure chamber, whereby a radial spacing between an outer circumference of the gear wheels and the circumferential walls is increased, and wherein the radial spacing between the outer circumference of the gear wheels and the circumferential walls assumes different values within the grooves, a first one of the respective grooves defining a first angular range ($\alpha$1) in which a radial spacing between the outer circumference of the first gear wheel and the circumferential wall is a first radial spacing, and a second angular range ($\alpha$2) in which a radial spacing between the outer circumference of the first gear wheel and the circumferential wall is a second radial spacing, wherein the second radial spacing is less than the first radial spacing, and a second one of the respective grooves defining a first angular range ($\beta$1) in which a radial spacing between the outer circumference of the second gear wheel and the circumferential wall is a third radial spacing, and a second angular range ($\beta$2) in which a radial spacing between the outer circumference of the second gear wheel and the circumferential wall is a fourth radial spacing, wherein the fourth radial spacing is less than the third radial spacing, and wherein the first radial spacing is constant, and wherein the third radial spacing is constant.

* * * * *

UNITED STATES PATENT AND TRADEMARK OFFICE

CERTIFICATE OF CORRECTION

PATENT NO. : 8,444,406 B2
APPLICATION NO. : 12/443328
DATED : May 21, 2013
INVENTOR(S) : Alexander Fuchs It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1057 days.

Signed and Sealed this
Eighth Day of September, 2015

Michelle K. Lee

Michelle K. Lee
*Director of the United States Patent and Trademark Office*